US007174899B2

(12) United States Patent
Lane

(10) Patent No.: US 7,174,899 B2
(45) Date of Patent: Feb. 13, 2007

(54) HAIR ACCESSORY

(75) Inventor: Teresa Lane, Kansas City, MO (US)

(73) Assignee: Celebrity Signatures International, Inc., Kansas City, MO (US)

( * ) Notice: Subject to any disclaimer, the term of this patent is extended or adjusted under 35 U.S.C. 154(b) by 11 days.

(21) Appl. No.: 10/427,315

(22) Filed: May 1, 2003

(65) Prior Publication Data

US 2004/0216760 A1 Nov. 4, 2004

(51) Int. Cl.
*A45D 8/04* (2006.01)
*A41G 3/00* (2006.01)

(52) U.S. Cl. ..... 132/273; 132/201

(58) Field of Classification Search ..... 132/201, 132/53, 54, 273–278, 55
See application file for complete search history.

(56) References Cited

U.S. PATENT DOCUMENTS

| | | | | | |
|---|---|---|---|---|---|
| 541,125 | A * | 6/1895 | Simonson | 132/53 |
| 3,280,826 | A * | 10/1966 | Jenkins | 132/201 |
| D229,240 | S * | 11/1973 | Fox | D28/41 |
| 5,501,239 | A * | 3/1996 | Walker | 132/275 |
| 5,899,211 | A * | 5/1999 | Brown | 132/201 |
| 6,257,250 | B1 * | 7/2001 | Sartena | 132/275 |
| 6,629,536 | B1 * | 10/2003 | Lane | 132/53 |

* cited by examiner

*Primary Examiner*—John J. Wilson
*Assistant Examiner*—Robyn Doan
(74) *Attorney, Agent, or Firm*—Lathrop & Cage LC

(57) ABSTRACT

A method for fabricating a hair accessory includes providing a hair clip having a plurality of tines, providing at least one support member having a plurality of strands extending therefrom and coupling the at least one support member to at least one of the plurality of tines.

12 Claims, 5 Drawing Sheets

HAIR ACCESSORY

BACKGROUND OF THE INVENTION

This invention relates generally to hair accessories and, more particularly, to hair accessories that supplement the natural hair of a user.

Users supplement their natural hair to allow a wider variety of hair styles to be imparted to the user's hair. Additionally, when users are endowed with relatively little hair, the users can supplement their hair to create the impression of a fuller head of hair. Known hair pieces provide for these objectives by attaching a hair switch to a hair clip such that the hair piece hangs from the hair clip, and the hair clip remains visible. However, the user may wish to wear a hair accessory to supplement the user's natural hair without a visible attachment device.

BRIEF SUMMARY OF THE INVENTION

In one aspect, a hair accessory is provided. The hair accessory includes a hair clip having a plurality of tines and at least one support member having a plurality of strands extending therefrom. The at least one support member is coupled to at least one of the plurality of tines.

In another aspect, a hair accessory is provided. The hair accessory includes a hair clip including a first clip portion and a second clip portion joined to the first clip portion along a hinge. The first and second clip portions are biased together by a spring. Each of the first and second clip portions have a plurality of tines on a respective side of the hinge. The hair accessory further includes at least one support member having a plurality of strands extending therefrom. The at least one support member is coupled to at least one of the plurality of tines of at least one of the first and second clip portions.

In a further aspect, a method for fabricating a hair accessory is provided. The method includes providing a hair clip having a plurality of tines, providing at least one support member having a plurality of strands extending therefrom and coupling the at least one support member to at least one of the plurality of tines.

DETAILED DESCRIPTION OF THE INVENTION

Figure 1:
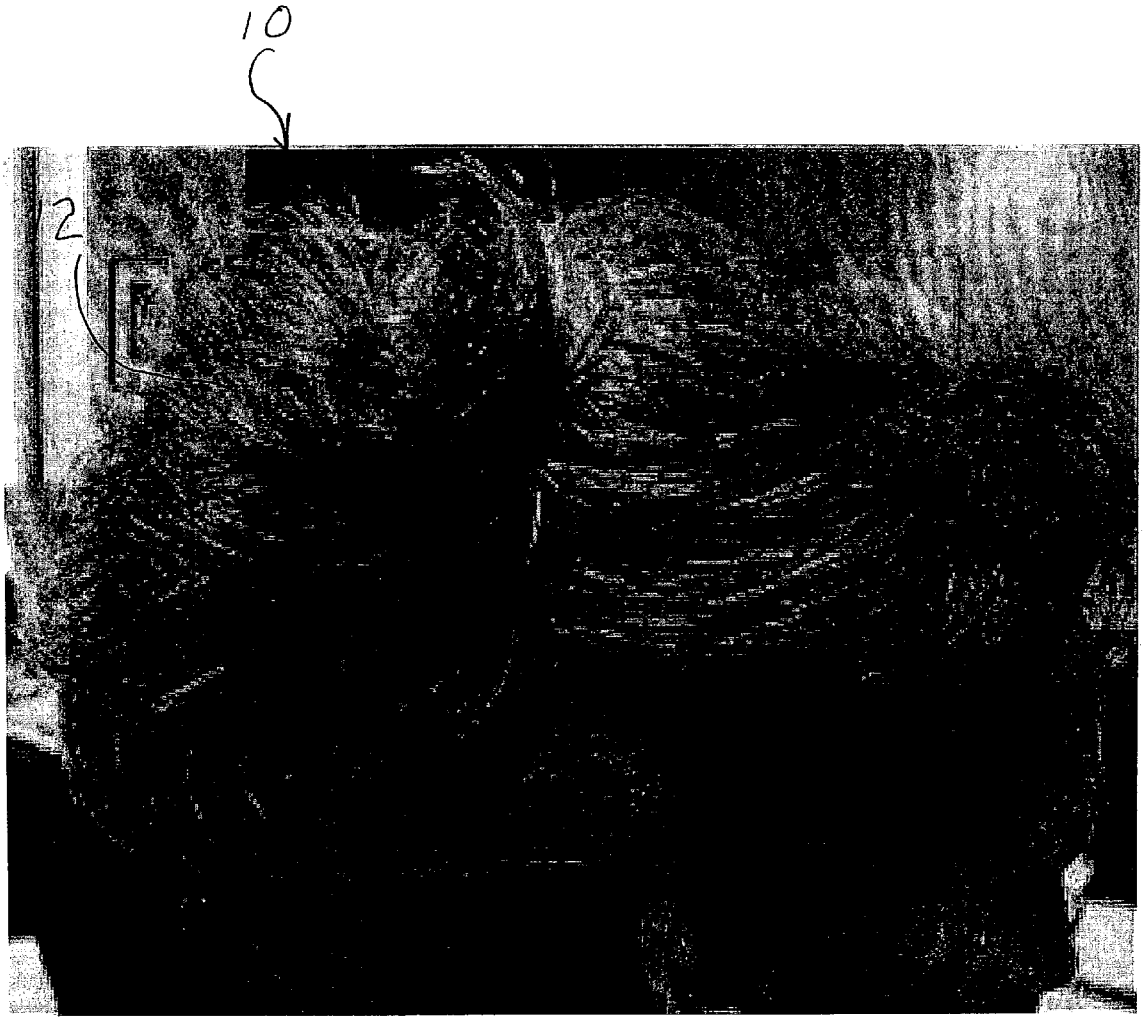
FIG. 1 is a perspective view of one embodiment of a hair accessory.

FIG. 1 is a perspective view of one embodiment of a hair accessory 10 including a plurality of hair strands 12. A hair clip (not shown in FIG. 1) is beneath strands 12 and is substantially concealed from sight by strands 12. The user can utilize the addition of hair strands 12 to the user's natural hair to provide various hair styles, some of which may not be attainable, or desirable in appearance, without hair accessory 10.

Figure 2:
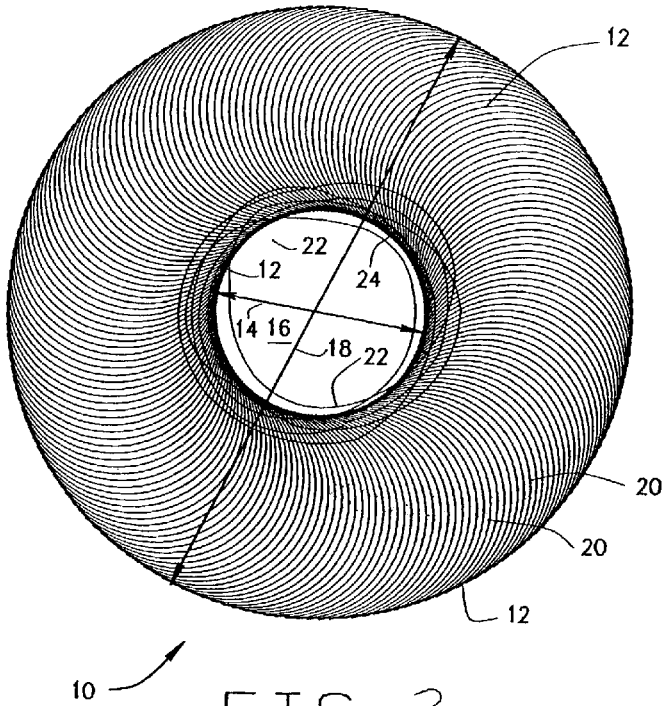
FIG. 2 is a plan view of a hair accessory in accordance with one embodiment of the invention.

FIG. 2 is a plan view of one embodiment of a hair accessory 10 including a plurality of arcuately extending hair strands 12 including synthetic hair. In an exemplary embodiment, the synthetic hair is fabricated from a polymer fiber such as modacrylic. In another embodiment, the synthetic hair is fabricated from a polymer fiber other than modacrylic, such as, for example, acrylic. In an alternative embodiment, hair strands 12 include natural hair. In a further alternative embodiment, hair strands 12 include at least one of synthetic hair and natural hair. Hair accessory 10 further includes an inner diameter 14 forming a bore 16, and an outer diameter 18. In one embodiment, inner diameter 14 is between about 6 centimeters (cm) and about 10.5 cm. In another embodiment, inner diameter 14 is between about 7 cm and about 9.5 cm. In another embodiment, inner diameter 14 is between about 8 cm and about 8.5 cm. In an exemplary embodiment, inner diameter 14 is about 8.25 cm. Strands 12 include a plurality of outward arcing strands 20 and a plurality of inward arcing strands 22. Arcuately extending strands 12 have varying lengths wherein each strand 12 is between about 7.5 cm and about 10.2 cm long and wherein strands 12 average about 9 cm in length. Each strand 12 is curved such that, although the length of each strand 12 is about 9 cm, the distance from one end of each strand 12 to the other end of each strand 12 is about 6 cm and, therefore, outer diameter 18 is about 20.5 cm. Accordingly, each strand includes an arc approximately equal to an arc of a circle having a diameter of approximately 8.25 cm, and inward arcing strands 22 substantially follow an inner surface 24 defined by inner diameter 14 such that inward arcing strands 22 extend substantially co-arcuate with inner surface 24 and remain within about 2 cm from inner surface 24.

Figure 3:
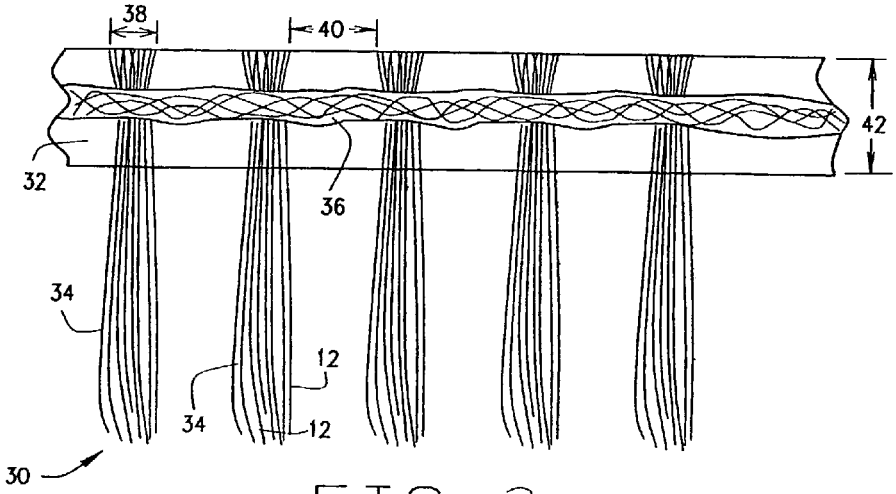
FIG. 3 is a side view of a portion of a strand retention member utilized in fabrication of the hair accessory shown in FIG. 2.

FIG. 3 is a side view of a portion of a strand retention member 30 utilized in hair accessory 10. Strand retention member 30 includes a support member 32 upon which is mounted a plurality of strand bundles 34. Each strand bundle 34 is attached to strand retention member 30 by a plurality of threads 36. Each bundle 34 includes between about fifteen and about forty strands 12. Each bundle 34 has a width 38 of about 1.6 millimeter (mm) and is separated from other bundles 34 by a spacing 40 of about 0.8 mm. Support member 32 includes a width 42 of about 9.5 mm. Strands 12 extend arcuately in a direction normal to the plane of width 42, e.g., into FIG. 2 or out from FIG. 2.

Figure 4:
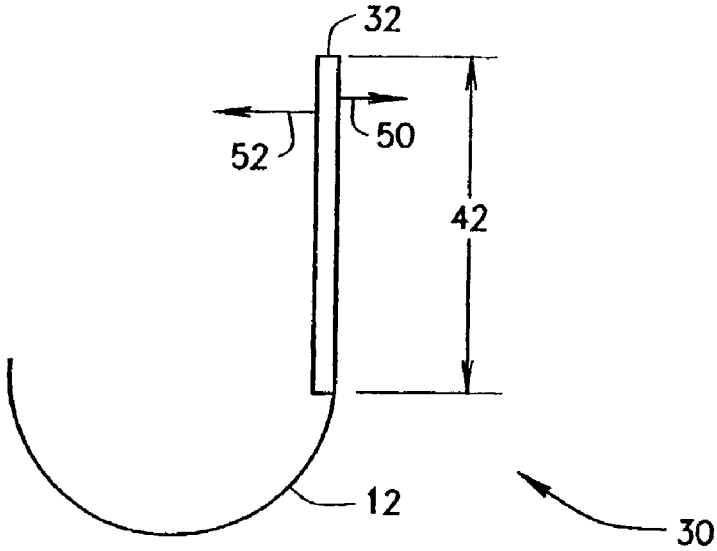
FIG. 4 is an end view of the strand retention member shown in FIG. 3.

FIG. 4 is an end view of strand retention member 30 illustrating a first direction 50 normal to width 42 and a second direction 52 normal to width 42. Strands 12 arcuately extend in second direction 52.

Figure 5:
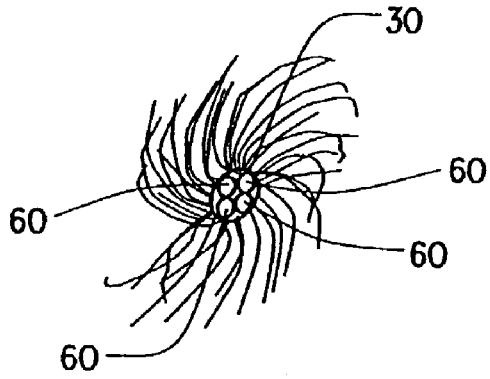
FIG. 5 is a cross-sectional view of the strand retention member shown in FIG. 3 wrapped around a plurality of resilient members.

FIG. 5 is a cross-sectional view of strand retention member 30 spirally wrapped around a plurality of resilient members 60. In an exemplary embodiment, strand retention member 30 is spirally wrapped around the four resilient members 60.

During fabrication of hair accessory 10, strand retention member 30 is spirally wrapped around at least one resilient member 60 substantially forming a circle defined by inner diameter 14 (shown in FIG. 1). In one embodiment, strand retention member 30 is wrapped around at least one resilient member 60 forming a continuous loop and can be in a shape other than substantially forming a circle, such as, for example, an oval. In an alternative embodiment, strand retention member 30 is spirally wrapped around at least one resilient member having two ends which are joined with an attachment device. In an exemplary embodiment, the ends are sewn together. In another embodiment, the attachment device is a snap. In an alternative embodiment, the attachment device is a hook and loop pressure fastener (velcro). In a further embodiment, the attachment device is a button fastener. Because strands 12 extend arcuately normal to width 42, spirally wrapping strand retention member 30 causes more than 50% of strands 12 to extend outward forming outward arcing strands 20 and less than 50% of strands 12 extend inward forming inward arcing strands 22. In an exemplary embodiment, a helix angle is chosen in coordination with inner diameter 14 such that at least 80% of strands 12 are outward arcing strands 20. In one embodiment, strand retention member 30 is spirally wrapped around a plurality of resilient members and thus hair accessory 10 is still useable if one resilient member should break. In another embodiment, strand retention member 30 is spirally wrapped around four resilient members and thus hair accessory 10 is useable if one or more resilient members break. While more than four resilient members may provide a longer life and withstand the breakage of many resilient members, utilizing four resilient members provides a cost-effective and long lasting hair accessory 10.

Figure 6:
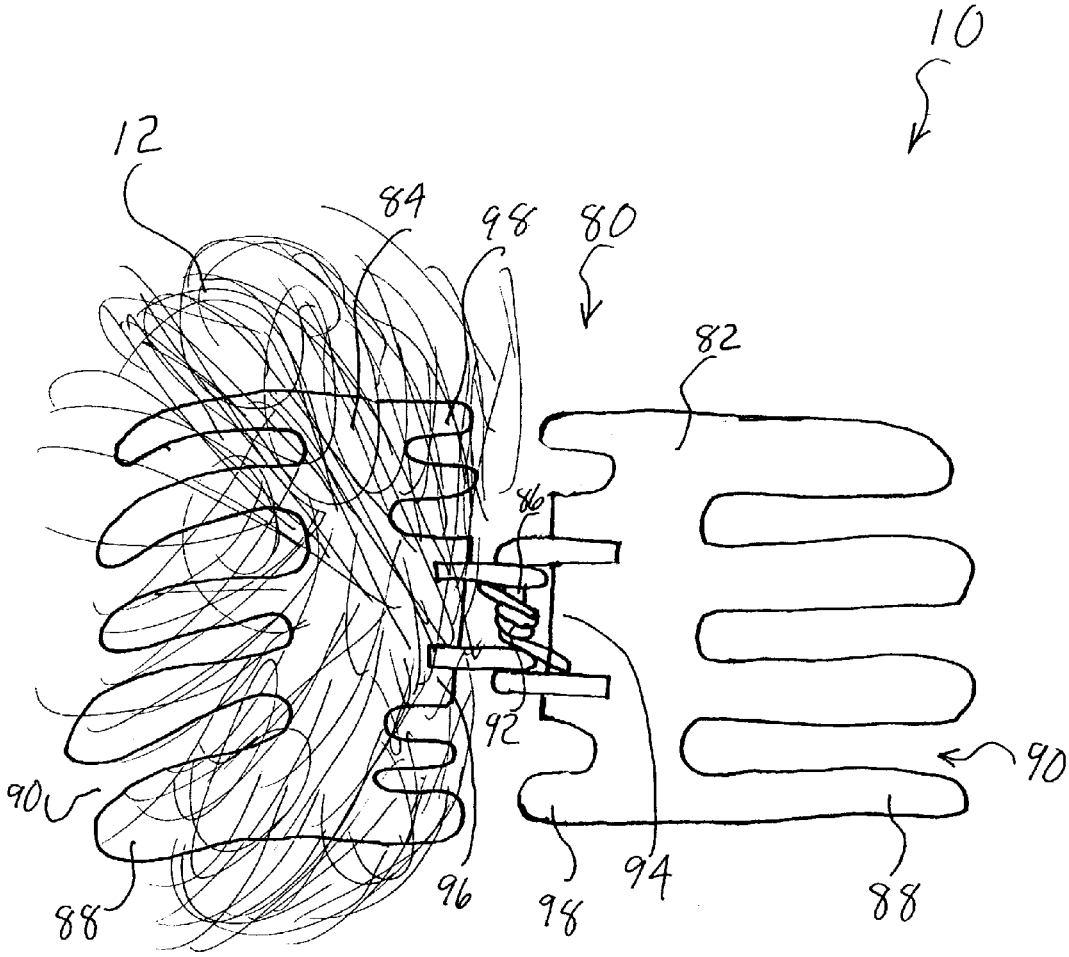
FIG. 6 is a front view of the hair accessory shown in FIG. 2 attached to an open hair clip.

FIG. 6 is a front view of hair accessory 10 coupled to an open hair clip 80. Clip 80 includes first and second clip portions 82 and 84 joined together by a hinge pin 86. First and second clip portions 82 and 84 are formed with a plurality of tines 88 separated by spaces 90. In one embodiment, tines 88 of at least one of first and second clip portions 82 and 84 are arcuate. When clip 80 is in a closed position, tines 88 of one clip portion are received in spaces 90 between tines 88 of the other clip portion. A spring 92 engages first and second clip portions 82 and 84 and biases clip 80 to a closed position. In the exemplary embodiment, first and second clip portions 82 and 84 are each provided with a handle 94 and 96 on the opposite side of the hinge pin 86 from the tines 88. By applying a force on handles 94 and 96 toward each other, clip 80 can be opened to enable the clip 80 to be inserted into the user's hair. Additionally, at least one of first and second portions 82 and 84 have at least one shoulder 98 on the opposite side of the hinge pin 86 from the tines 88. As shown in FIG. 6, first and second clip portions have a pair of shoulders on either side of their respective handles. Shoulders 98 are spaced apart from handles 94 and 96. In one embodiment, first and second clip portions 82 and 84 have a plurality of shoulders 98 on either side of handles 94 and 96.

Figure 7:
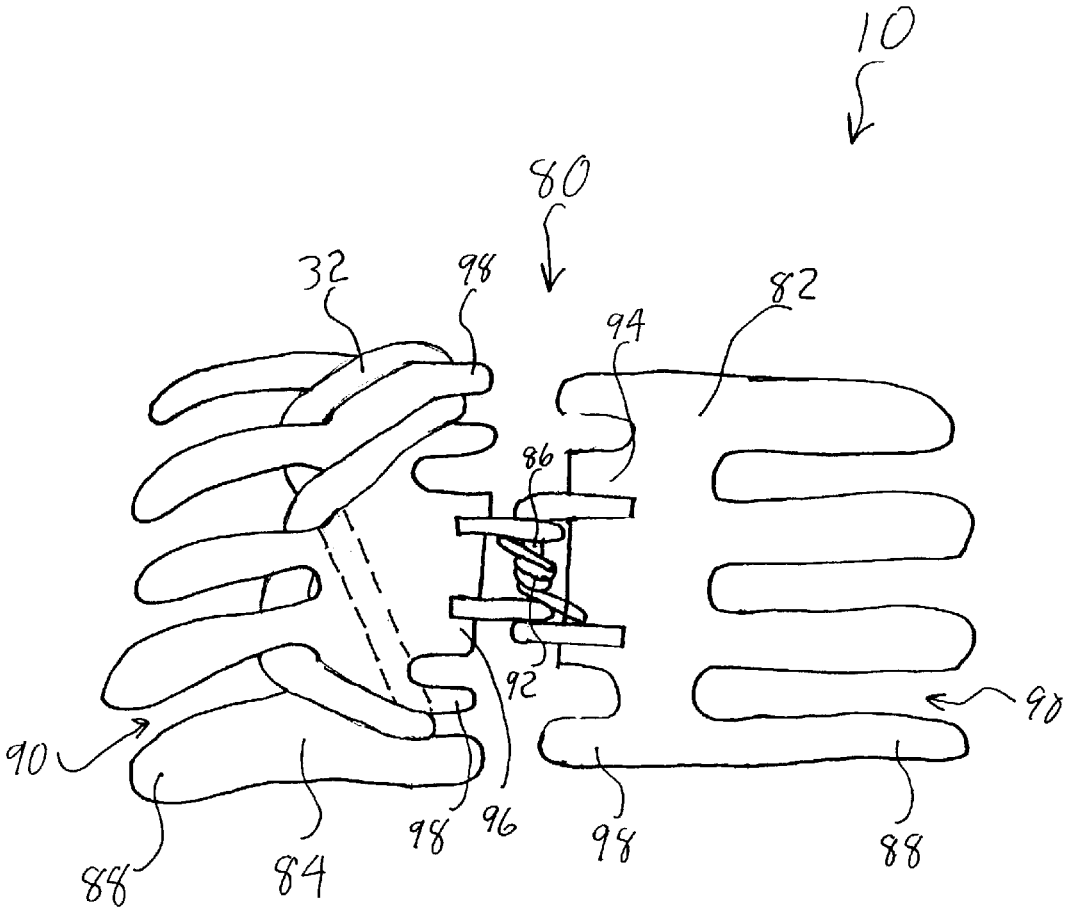
FIG. 7 is a front view of the hair accessory shown in FIG. 6 without hair strands.

FIG. 7 is a front view of hair accessory 10 without hair strands coupled to clip 80. Support member 32 is coupled to at least one of first and second clip portions. In the exemplary embodiment, support member 32 is looped around shoulder 98 of second clip portion 84. Support member 32 is weaved between tines 88 of second clip portion 84 until support member 32 can be looped around another shoulder 98 of second clip portion 84 on the opposite side of handle 96. In one embodiment, support member 32 is weaved through tines 88 of second clip portion 84 and support member 32 is looped around only one shoulder 98 of second clip portion 84. In another embodiment, support member 32 is weaved through tines 88 of second clip portion 84 without looping around any shoulders 98 of second clip portion 84.

In another embodiment, support member 32 is looped around one shoulder 98 of second clip portion. Support member 32 is twisted around at least one tine 88 of second clip portion 84, and support member 32 is looped around another shoulder 98 of second clip portion 84 on the opposite side of handle 96. In another embodiment, support member is looped around only one shoulder 98 of second clip portion 84 and support member 32 is twisted around at least one tine 88 of second clip portion 84. In a further embodiment, support member 32 is twisted around at least one tine 88 of second clip portion 84 without looping around any shoulders 98 of second clip portion 84.

While the invention has been described in terms of various specific embodiments, those skilled in the art will recognize that the invention can be practiced with modification within the spirit and scope of the claims.

What is claimed is:

1. A hair accessory comprising:

a hair clip comprising:

a first clip portion; and a second clip portion joined to said first clip portion along a hinge, said first and second clips portions biased together by a spring, said first and second clip portions having a plurality of tines on one side of said hinge; and at least one support member having a plurality of strands extending therefrom; and a plurality of resilient members, said at least one support member spirally wrapped around said plurality of resilient members, each resilient member forming a continuous loop, said at least one support member coupled to at least one of said plurality of tines of at least one of said first and second clip portions.

2. The hair accessory in accordance with claim 1 wherein said at least one support member is coupled to at least two of said plurality of tines without the use of adhesive.

3. The hair accessory in accordance with claim 1 wherein said plurality of strands extend from said at least one support member such that said strands substantially conceal said hair clip when said hair clip is attached to a head of a user.

4. The hair accessory in accordance with claim 1 wherein said at least one support member is weaved between said plurality of tines of at least one of said first and second clip portions.

5. A method for fabricating a hair accessory, said method comprising the steps of:

providing a hair clip having a plurality of tines;

providing at least one support member having a plurality of strands extending therefrom;

spirally wrapping the at least one support member around a plurality of resilient members, each resilient member forming a continuous loop; and coupling the at least one support member to at least one of the plurality of tines.

6. The method in accordance with claim 5 wherein said step of providing at least one support member having a plurality of strands extending therefrom further comprises providing hair strands extending from the at least one support member such that the plurality of hair strands substantially conceal the hairclip when the hair clip is attached to a head of a user.

7. The method in accordance with claim 5 wherein the at least one support member is coupled to at least two of the plurality of tines without the use of adhesive.

8. The method in accordance with claim 5 wherein said step of coupling the at least one support member to at least one of the plurality of tines further comprises weaving the at least one support member between the plurality of tines.

9. The method in accordance with claim 5 wherein said step of coupling the at least one support member to at least one of a plurality of tines further comprises looping the at least one support member around at least one of the plurality of tines.

10. The method in accordance with claim 5 wherein said step of coupling the at least one support member to at least one of a plurality of tines further comprises twisting the at least one support member around at least one of the plurality of tines.

11. The method in accordance with claim 5 wherein said step of providing at least one support member having a plurality of strands further comprises providing hair strands comprising at least one of natural hair and synthetic hair.

12. The method in accordance with claim 11 wherein providing hair strands comprising at least one of natural hair and synthetic hair further comprises providing synthetic hair comprising at least one of acrylic fiber and a modacrylic fiber.

* * * * *